United States Patent [19]

Welzen et al.

[11] Patent Number: 4,564,489

[45] Date of Patent: Jan. 14, 1986

[54] METHOD AND HOLDER FOR THE MANUFACTURE OF ANNULAR CORES

[75] Inventors: Jozef T. A. M. Welzen; Theodorus G. W. Stijntjes; Aant B. D. van der Meer, all of Eindhoven; Rudolf O. M. Löbel; Berend J. Nijhof, both of Uden, all of Netherlands

[73] Assignee: U.S. Philips Corporation, New York, N.Y.

[21] Appl. No.: 533,338

[22] Filed: Sep. 19, 1983

[30] Foreign Application Priority Data

Sep. 20, 1982 [NL] Netherlands ..... 8203620

[51] Int. Cl.[4] ..... F27B 9/14

[52] U.S. Cl. ..... 264/58; 264/57; 432/258; 432/259

[58] Field of Search ..... 264/57, 58; 432/258, 432/259

[56] References Cited

U.S. PATENT DOCUMENTS

| | | | |
|---|---|---|---|
| 2,306,433 | 12/1942 | Gednetz | 264/58 |
| 2,315,395 | 3/1943 | Brown | 432/258 |
| 2,867,888 | 1/1959 | Schaefer et al. | 264/57 |
| 2,883,729 | 4/1959 | Ito | 264/57 |
| 3,768,963 | 10/1973 | Walker et al. | 432/259 |
| 3,948,594 | 4/1976 | Irwin | 264/58 |
| 4,466,793 | 8/1984 | Murakami et al. | 432/258 |

FOREIGN PATENT DOCUMENTS

| | | | |
|---|---|---|---|
| 1196109 | 7/1965 | Fed. Rep. of Germany . | |
| 1086773 | 2/1955 | France | 432/258 |
| 47-18911 | 9/1972 | Japan | 264/257 |

*Primary Examiner*—James Derrington

*Attorney, Agent, or Firm*—Thomas A. Briody; William J. Streeter; Leroy Eason

[57] ABSTRACT

In the manufacture of a flared ferromagnetic annular core for a television deflection unit in which a moulding (13) consisting of compressed starting material is supported in a hollow holder (11) having an inclined inner wall (12) on which a considerable part of the flared outer surface of the moulding (13) bears during sintering. Allows compression and expansion of the moulding to take place.

2 Claims, 6 Drawing Figures

METHOD AND HOLDER FOR THE MANUFACTURE OF ANNULAR CORES

BACKGROUND OF THE INVENTION

The invention relates to a method of manufacturing a rotationally symmetrical flared annular core of oxide ceramic ferromagnetic material suitable for a television deflection unit in which a moulding consisting of a compressed starting material is sintered to form a ferromagnetic core. The invention also relates to a ceramic holder for use in a method of manufacturing annular cores.

Annular cores of ferromagnetic material are used in T.V. deflection units. Such annular cores may be conical or frusto-conical. The inside diameter of the rotationally symmetrical annular core, viewed in the axial direction, increases from the rear side of the core to its front which is to face the display screen. It is usual to manufacture such cores from an oxide ceramic material, for example ferrite. Ferrite cores are manufactured by mixing ferrite-forming starting materials, for example oxides of iron ($Fe_2O_3$), of nickel (NiO) and of zinc (ZnO), by compressing the oxide mixtures, with or without the use of a binder, into moulds and sintering these mouldings. When the annular core consist, for example, of nickel-zinc-ferrite, sintering is carried out at a temperature of approximately 1,000° to 1,400° C. During sintering a so-called solid state reaction occurs so that the metal oxides are combined to form a spinel lattice which causes the ferromagnetic properties. At the same time the moulding is sintered to form a mechanically rigid ceramic body.

It has been found that the annular cores manufactured in this manner often show large or small cracks after sintering and subsequent cooling, in particular in curved places where the inside diameter or outside diameter increases considerably and which may even cause fracturing of the annular core in the case the cracks are circumferential.

In German Patent Specification No. 1,196,109 the occurrence of these cracks is ascribed to an inhomogeneous concentration of the moulding during the compression process and it has been suggested to replace the compression by a centrifuging process in a magnetic field. Although this measure in itself seems to make sense, it has been found that an annular cores which have been incorporated in ceramic holders during the sintering process cracks may also occur when the moulding has been very homogeneously concentrated. These holders (so-called "saggars") are necessary to be able to stack the annular cores when the furnace in which the sintering process is carried out is to be filled economically. Such holders have the form of a cup having a bottom in which a central aperture is provided. The annular cores are "suspended" in these apertures during the sintering process. Another disadvantage is that the annular cores fired in this manner sometimes show a certain unconcentricity.

SUMMARY OF THE INVENTION

It is the object of the invention, to provide a method of manufacturing annular cores which, in the case in which the annular cores are incorporated in holders during the sintering process, results in annular cores which overcome at least some of the above difficulties.

The invention provides the method where during the sintering process the moulding is supported by a hollow holder having an inclined inner wall on which a considerable portion of the widest part of the flared outer surface of the moulding bears slidably.

It has been found that annular cores satisfying the imposed requirements can be manufactured by means of the method according to the invention.

The invention also provides a holder for use with the above method.

An embodiment of the invention will be described in greater detail, by way of example, with reference to the accompanying drawings.

DESCRIPTION OF THE PREFERRED EMBODIMENT

Figure 1:
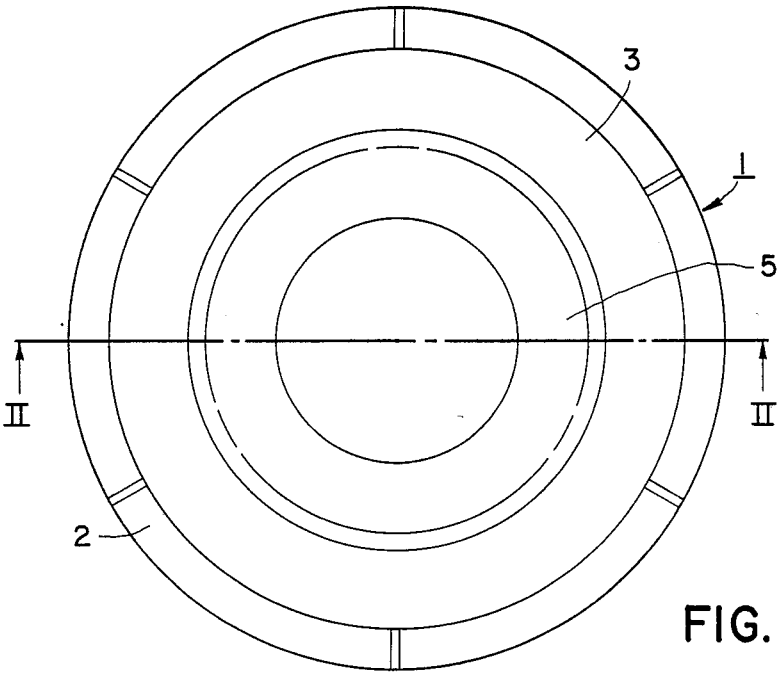
FIG. 1 is a plan view of a conventional ceramic holder having an annular core therein.
Figure 2:
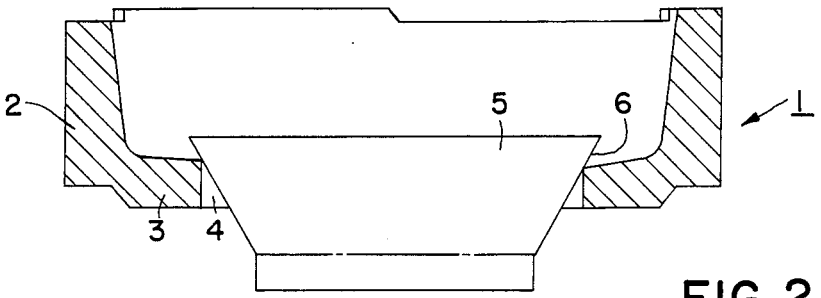
FIG. 2 is a cross-sectional side elevation taken along the line II—II of FIG. 1.

Upon sintering annular cores it is important in connection with an economic filling of the furnace that the annular cores should be incorporated in individual holders which can be stacked. FIG. 1 is a plan view of such a holder 1 of a conventional type and FIG. 2 is a cross-sectional view taken on the line II—II of FIG. 1. The holder 1 which is sometimes termed "saggar" has the form of a cup with an upright side wall 2 and a bottom 3.

The bottom 3 has a central aperture 4. A moulding 5 to be sintered for an annular core is placed in the holder 1 in such manner that it projects through the aperture 4. The moulding 5 which in the case shown has on its outside a rotationally symmetrical shape which widens from a certain point conically, bears with its outside 6 on the edge of the aperture 4. The invention is based on the recognition that the sintered product may show cracks in that during sintering, in which the spinel structure is formed, the moulding 5 initially expands. This expansion cannot be compensated for by the holder 1. In fact the moulding 5 is jammed in the edge of the aperture 4. Depending on whether the moulding 5 consists of a prefired powder or of a non-prefired powder it has been found that the expansion may be from 0.5% to 4%.

Figure 3:
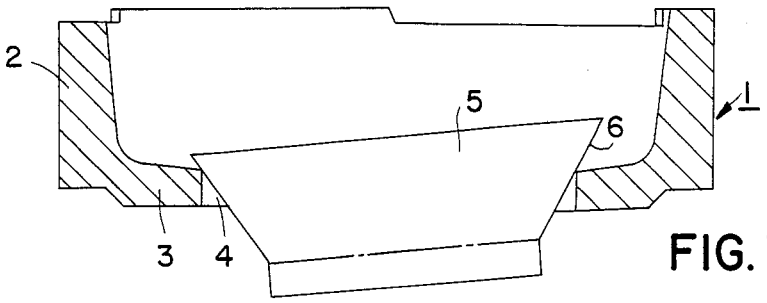
FIG. 3 is a similar view to that of FIG. 2 in which, however, the annular core has a different position.

Another problem with annular cores sintered in holders of the types shown in FIGS. 1 and 2 is that they may become suspended obliquely in the aperture 4. This situation is shown in FIG. 3. A moulding 5 which is sintered in an oblique position becomes unconcentric. This means that the final product has to be ground so as to return to the desired degree of concentricity or that the deflection unit in which it is used has to be provided with correction means to magnetically correct for the u concentricity which leads to an undesired influence of the electron beams during operation of the deflection unit.

The invention solves both above-mentioned problems in that during sintering and subsequent cooling the mould is incorporated in a holder of a new design. The newly designed holder 11 is shown in the plan view of FIG. 4 and in the cross-sectional view of FIG. 5 taken on the line V—V of FIG. 4. The holder has the feature that it has an inclined inner wall 12 on which a considerable part of the outer surface of a moulding 13 to be sintered bears during the sintering process. The inclined variation of the inner wall 12 of the holder 11 and of the outer surface of the moulding 13 should for that purpose be matched to each other as closely as possible. This design of holder 11 enables the moulding to slide upwards during expansion and to slide downwards during subsequent shrinkage. In this way stresses which may give rise to the occurrence of cracks cannot be formed in the material of the moulding 13. In order to make best use of this "sliding surface" effect at least 25% of the conical part of the outer surface of the moulding 13 should be supported by the inclined wall 12.

Since in the holder 11 the moulding does not bear directly on the edge of an aperture, as is the case in the conventional type, but is supported by an inclined face over a considerable part of its outer surface, possible inclined suspension and resulting unconcentricity is also prevented to a considerable extent. Hence the dimensional stability of the final product is much better than when conventional holders are used.

Figure 4:
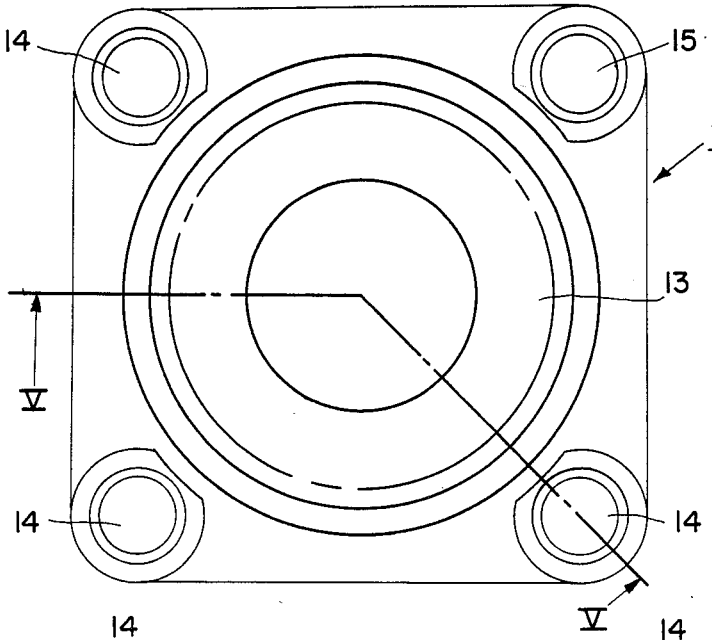
FIG. 4 is a plan view of a ceramic holder according to the invention having an annular core therein.
Figure 5:
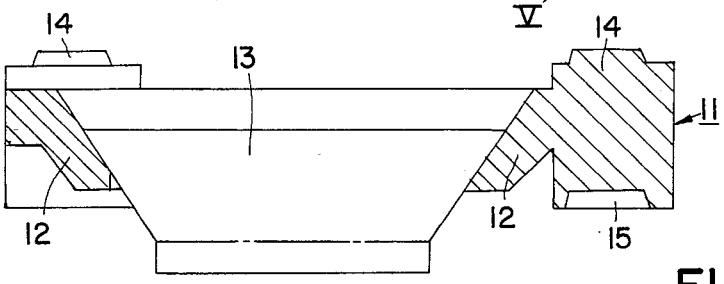
FIG. 5 is a cross-sectional side elevation taken along the line V—V of FIG. 4.

In order to be able to stack the holders of the type shown in FIGS. 4 and 5 on each other, they have projections 14 on one side fitting in cavities 15 recessed on the other side.

Figure 6:
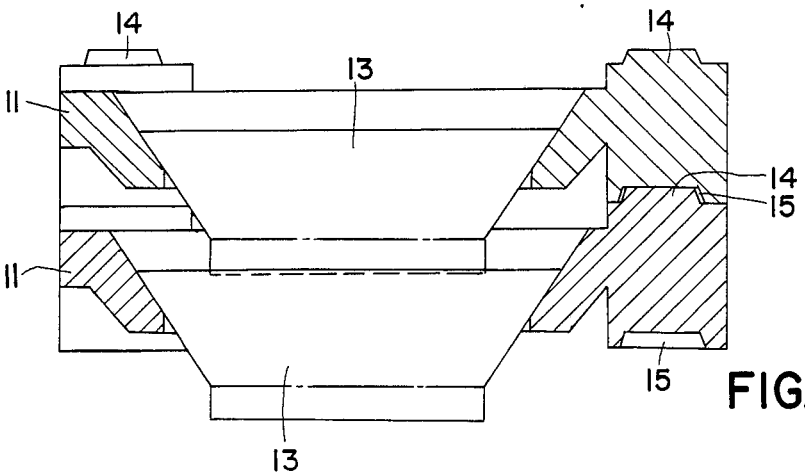
FIG. 6 is a cross-sectional side elevation through a stack of holders of the type shown in FIG. 4.

FIG. 6 is a cross sectional view of a stack of two of such holders 11 having mouldings 13 placed therein.

In addition to the above advantages, the use of a holder having inclined walls to support a conical moulding during sintering may also involve additional advantages. For example, the force exerted on the wall of the holder is reduced because the moulding can move upwards during expansion. So the wall may be thinner than in a conventional holder, which is favourable from a point of view of energy savings as during a sintering cycle less material need be heated. In particular, material may be removed from the sides of the holder in such manner that from the circular shape in FIG. 1 the at least substantially square shape of FIG. 4 is obtained which occupies a considerably smaller area. In this manner it has proved possible to obtain an approximately 35% better fill of the furnace area. In its simplest form the holder to be used in the described method consists of a substantially square base plate having a circular aperture in the centre with a wall extending obliquely to the base plate, in which projections are present for supporting or engaging a second holder at the four corner points.

Suitable materials for the holder are, for example, aluminium oxide ($Al_2O_3$), selimanide ($Al_2O_3.SiO_2$), lelibide ($Al_2O_3.SiO_2+SiC$) or silicon carbide (SiC).

What is claimed is:

1. A method of manufacturing rotationally symmetrical flared annular cores of oxide-ceramic ferromagnetic material suitable for a television deflection unit, in which mouldings consisting of compressed starting material and having a flared outer surface are sintered to form such flared annular ferromagnetic cores, comprising:

locating each of said mouldings in an individual holder, each holder having a substantially square base, the corners of which have a projection one one side thereof and a matching recess on the other side thereof so that the projections of one base may be fitted into the recesses of another base, said base including a central aperture connected with a frustoconical wall tapered to support one of said mouldings along a portion of said flared outer surface;

stacking the holders having mouldings therein in a vertical column by fitting the projections of one base into the recesses of another base; and sintering said stacked mouldings, said mouldings during sintering being free to slide in contact with said frustoconical wall in response to expansion and contraction of said moulding without cracking said molding.

2. A method as claimed in claim 1, wherein at least 25% of the area of the flared outer surface is supported by said tapered wall.

* * * * *

UNITED STATES PATENT AND TRADEMARK OFFICE

CERTIFICATE OF CORRECTION

PATENT NO. : 4,564,489

DATED : January 14, 1986

INVENTOR(S) : JOZEF T.A.M. WELZEN ET AL

It is certified that error appears in the above-identified patent and that said Letters Patent is hereby corrected as shown below:

In the Abstract, line 1 change "In the" to --Method of--

Signed and Sealed this

Fifteenth Day of September, 1987

*Attest:*

DONALD J. QUIGG

*Attesting Officer*

*Commissioner of Patents and Trademarks*